US005107768A

United States Patent [19]

Langenohl

[11] Patent Number: 5,107,768

[45] Date of Patent: Apr. 28, 1992

[54] PROJECTILE HAVING AN INTERIOR SPACE AND A METHOD OF PROTECTION THEREOF

[75] Inventor: Rolf Langenohl, Schirick, Fed. Rep. of Germany

[73] Assignee: Rheinmetall GmbH, Düsseldorf, Fed. Rep. of Germany

[21] Appl. No.: 562,601

[22] Filed: Aug. 3, 1990

[30] Foreign Application Priority Data

Aug. 12, 1989 [DE] Fed. Rep. of Germany ..... 3926711

[51] Int. Cl.[5] ..... F42B 12/58; F42B 39/00

[52] U.S. Cl. ..... 102/489; 29/1.2; 86/1.1; 86/20.14; 102/293; 102/367; 102/393; 102/473

[58] Field of Search ..... 102/367, 393, 473, 489, 102/293; 86/20.14, 1.1; 29/1.2, 1.21; 174/17 GF, 14 R, 25 P, 25 G

[56] References Cited

U.S. PATENT DOCUMENTS

| | | | |
|---|---|---|---|
| 2,216,010 | 9/1940 | Hobart | 174/17 GF |
| 2,432,568 | 12/1947 | Gambitta | 174/17 GB |
| 3,403,063 | 9/1968 | Walker | 174/25 G |
| 3,602,669 | 8/1971 | Meier | 174/14 R |
| 3,771,457 | 11/1973 | Buxton | 102/262 |
| 3,916,080 | 10/1975 | Wakamatsu | 174/17 GF |
| 4,665,828 | 5/1987 | Auer | 102/519 |
| 4,807,533 | 2/1989 | von Entress-Fürsteneck . | |
| 4,848,238 | 7/1989 | Böcker et al. . | |
| 4,961,383 | 10/1990 | Fishman et al. | 102/517 |

FOREIGN PATENT DOCUMENTS

| | | |
|---|---|---|
| 3619791 | 4/1988 | Fed. Rep. of Germany . |
| 3635361 | 4/1988 | Fed. Rep. of Germany . |

*Primary Examiner*—Harold J. Tudor
*Attorney, Agent, or Firm*—Spencer & Frank

[57] ABSTRACT

The invention relates to a projectile having an interior space in which disposable payloads and/or electronic components are arranged, and which are of a type intended to have an extended lifetime. To protect the interior components from corrosion, the interior space is filled with a protective gas, for example, argon, nitrogen or hydrogen, or a mixture of these gases. The protective gas may be present in the interior space at a greater than atmospheric pressure of, for example, three bar.

16 Claims, 2 Drawing Sheets

FIG.1
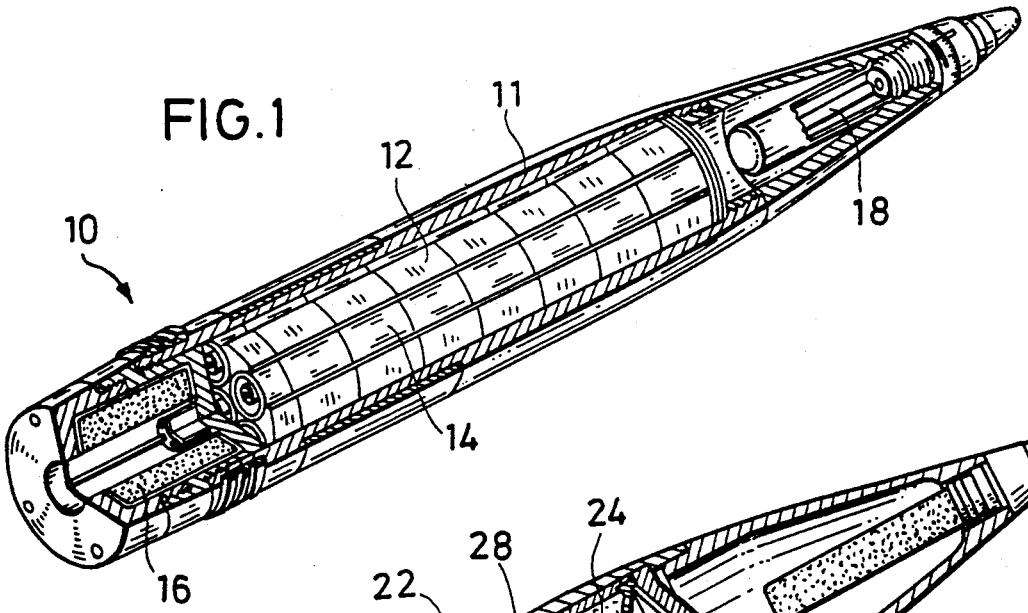
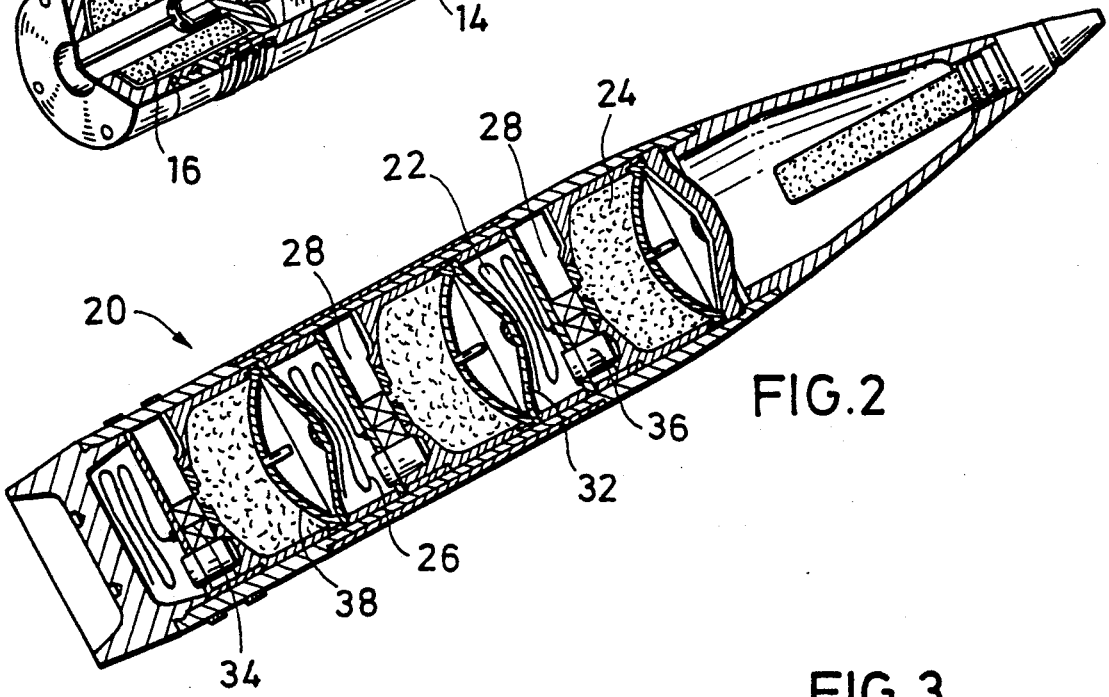
FIG.2
FIG.3
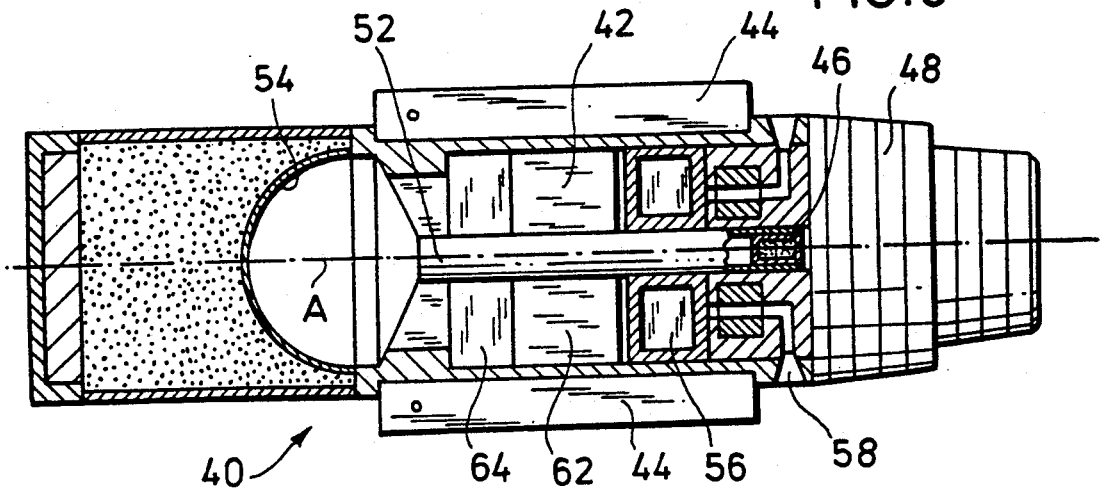

PROJECTILE HAVING AN INTERIOR SPACE AND A METHOD OF PROTECTION THEREOF

REFERENCE TO RELATED APPLICATIONS

This application claims the priority of Federal Republic of Germany application Ser. No. P 39 26 711.31 filed Aug. 1, 1989.

BACKGROUND OF THE INVENTION

The invention relates to a projectile having an interior space in which sensitive payloads and/or electronic components are arranged, and more particularly to a method and means for protecting the payloads and electronic components from corrosion.

A high-caliber carrier projectile (corresponding to FIG. 1) having, an artillery caliber of, for example, 155 mm or 203 mm, and in whose interior space is arranged an ejectable payload having a plurality of small sub-munition projectiles (bomblets) is known, for example, from DE-OS 3,841,908. Such sub-munition projectiles have ignition and safety devices which include a plurality of small mechanical precision elements arranged within a fuze housing. The fuze housing does not seal off these precision elements from the exterior.

A further high-caliber carrier projectile (corresponding to FIG. 2) having three sub-munition projectiles stacked in its interior space is known, for example, from DE-OS 3,635,361 and its U.S. counterpart U.S. Pat. No. 4,807,533. These sub-munition projectiles are each provided with a projectile-forming charge, a stabilizing parachute, a homing sensor having a transmitting and receiving antenna, an energy supply unit, a fuze and a safety unit. For storing these peripheral components of the sub-munition projectile an otherwise vacant large-volume storage space or other interior space is required in the carrier projectile.

An ejectable high-caliber carrier projectile or rocket projectile (corresponding to FIG. 3) having a sub-munition unit for attacking active armored targets, in the form of a warhead which has stabilizing fins and is capable of flying and being guided, is disclosed in German Patent DE-3,619,791 and its U.S. counterpart U.S. Pat. No. 4,848,238. The warhead has, one behind the other, a front charge with a proximity fuze for acting on the active armor, and a rear charge with a time delay fuze for acting on the main armor. For end-phase guidance of the warhead, and operation of the proximity fuze and delay fuze, a comprehensive target-detection sensor system and control mechanics having fuze and electronic units are provided.

In all of these prior art projectiles the sub-munition projectiles or disposable payloads are each provided with a suitable explosive mass. The disadvantage of these is that the explosive mass is able to diffuse out moisture into the gaseous atmosphere (air) of the free interior space of the projectile body. Because of this moisture, it is possible that—especially during prolonged storage (up to 20 years) or temperature variations which may occur—unprotected electronic components (micro-chips, contacts and conductor plates, etc.) or small mechanical precision components (e.g. the clockwork or timing mechanism) are predisposed to corrosion and, as a consequence, loss of their ability to function.

In the future, the interior structure of modern projectiles will be even more complicated. Electronic components will be used increasingly in such projectiles. However, the safe functioning of the projectile depends on 100 percent protection from corrosion of the interior structural components over the entire storage period. It is therefore mandatory to protect the delicate interior components from possible corrosion.

SUMMARY OF THE INVENTION

An object of the invention is to provide projectiles of the above type with protection against corrosion of delicate interior components and payloads. The invention solves this problem in a surprisingly simple fashion by providing that a corrosion inhibiting protective gas fills the free interior space of the projectile in which the components and payloads are arranged. The gas used in this connection may be a noble gas such as argon (Ar) or helium (He), an inert gas such as nitrogen ($N_2$) or a reducing gas such as carbon monoxide (CO), hydrogen ($H_2$), ammonia ($NH_4$) or methane gas ($CH_4$).

The protective gas used in this connection is preferably present in the interior of the projectile at an pressure between normal atmospheric pressure and 30 bar. The level of pressure determines the amount of gas to be introduced and should be selected depending on the type of gas, the type and caliber of the projectile, etc.

Carrier projectiles usually comprise two elements for assembly; thus it is possible, for example, that the tip of the projectile (ogive) or the projectile base may be unscrewed from the remaining projectile body. Usually, an O-ring seal, and/or an adhesive and sealing material and/or an exterior protective and sealing lacquer, is provided in the connecting region of these projectile elements. If the projectile experiences slight damage (for example, microscopic hair line ruptures subsequent to the dropping of the projectile) no damaging moisture can penetrate the projectile having the internal protection of the delicate components accorded by the protective gas according to the invention: Due to the greater than atmospheric pressure and the greater concentration of gas in the interior of the projectile the protective gas acts as a barrier and escapes very slowly from the interior to the exterior so that simple but effective prolonged protection is provided for the delicate components.

Although weatherproof transport or storage containers (magazine containers) for projectiles, containing moisture absorbing agents, such as kieselguhr, are generally known, this type of measure is not suitable for extending the life of the interior of projectiles because of the disadvantageous increase in the proportion of dead weight. In fact, it is precisely for the purpose of decreasing the proportion of dead weight that the sealing or encapsulation of components such as electronic components by means of synthetic resins has been eliminated in modern projectiles.

The method according to the invention for the protection of delicate components or payloads in the interior space of a projectile includes cleaning the interior space to remove moisture retaining particles by purging and/or flooding the space with an inert or other protective gas; and then permanently protecting the elements in the interior space against the danger of corrosion by retaining a quantity of the protective gas, preferably, at a certain greater than atmospheric pressure of, for example, approximately 3 bar.

BRIEF DESCRIPTION OF THE DRAWINGS

These and other features and advantages of the invention may be more completely understood from the following detailed description of the preferred embodiments of the invention with reference to the accompanying drawings in which:

FIG. 1 is a perspective view, partially in cross section, of a carrier projectile, for a plurality of sub-munition projectiles, in which a protective gas has been inserted according to the invention;

FIG. 2 is a sectional side view of a further carrier projectile, sub-munition projectiles having a projectile-forming charge in which a protective gas has been inserted according to the invention;

FIG. 3 is a sectional side view of a warhead which has two charge elements arranged in tandem, which is capable of flying and being guided, and in which a protective gas has been inserted according to the invention.

DESCRIPTION OF THE PREFERRED EMBODIMENTS

Figure 4:
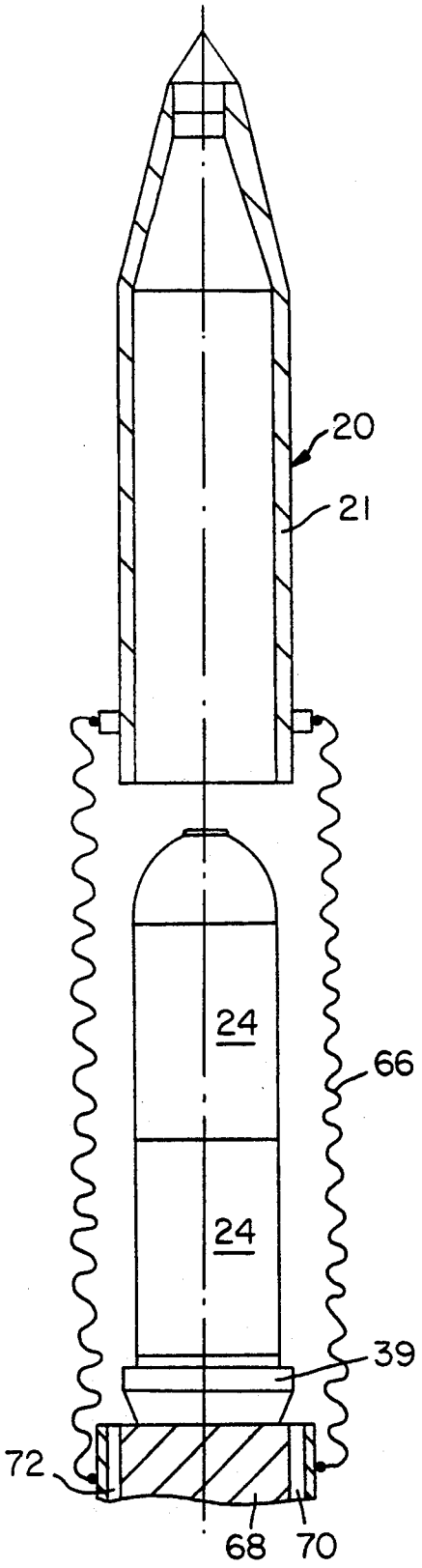
FIG. 4 is a schematic cross-sectional view of the carrier projectile of FIG. 2 during a process of purging and flooding the interior of the projectile according to the invention.

Referring to FIG. 1, reference numeral 10 designates a high-caliber bomblet carrier projectile such, as is disclosed in DE-OS 3,841,908, having an outer shell 11 in whose interior space 12 is arranged a plurality (here forty-nine) of small sub-munition projectiles (bomblets) 14. The carrier projectile 10 is provided on its tail end with a base-bleed set 16 for increasing the range and may be fired to reach distances of up to forty kilometers. The sub-munition projectiles 14 are ejected from the carrier projectile !0 over a target region by means of an ejection load or charge 18. The loading space or interior space 12 of the projectile 10 is, in this instance, filled with a protective gas to a greater than atmospheric pressure to protect the corrosion sensitive precision components in the fuze housings of the bomblet projectiles, which are not sealed gas tight. The pressure of the protective gas should be selected depending on the strength of the projectile housing and the volume of the interior space 12 and may be between 1 and 30 bar. The caliber and the diameter of the projectile are important factors as well. For example, a protective gas at a pressure of 15 bar may be advisable for a mortar projectile having a caliber of 40 mm, in order to have sufficient amounts of the gas in place to compensate for possible leakage. In a larger projectile having a caliber of, for example, 203 mm, a pressure slightly greater than atmospheric pressure of approximately 2 bar may be sufficient.

A similar carrier projectile 20, shown in FIG. 2, has provided in the interior space 22 three intelligent sub-munition units 24. These sub-munition units 24 are each provided with a projectile-forming charge 38, which is fired at a height, for example, of 120 to 15 meters above a detected and aimed at target. Such a sub-munition unit 24 functions with a parachute 26, a target searching and target detecting sensory unit 28 having a transmission and receiving antenna 32 as well as an energy supply unit 34, and a fuze and safety unit 36. Inclusion in the sub-munition units 2 of such components requires an interior space 22 having a relatively large volume inside the carrier projectile 20. For the protection of these components as well as peripheral sub-munition projectile elements, the interior space 22 is filled with a protective, preferably inert, gas or gas mixture, including, for example, helium. In order to accommodate a greater amount of the gas or gas mixture in the interior space 22, the gas is provided at a certain greater than atmospheric pressure. Thus, if the interior space 22 has a volume of 2.8 liter (at atmospheric pressure) it may contain 7.5 liters of the inert gas at a pressure of approximately 3 bar. This is sufficient to provide lasting protection of the components.

FIG. 3 shows a warhead 40 designed as an enlarged sub-munition projectile. The warhead 40 is provided with an interior space 42 which has structural components within it. The warhead 40 may be ejected, for example, from a high caliber carrier projectile, a rocket or an airplane, is able to fly and may be directed by means of outwardly pivoting stabilizing fins 44. In order to detect the target and detonate an initial active charge 46 (projectile-forming charge) at an appropriate distance (stand-off) from the target, the warhead 40 is provided with a frontal sensor head 48. Disposed behind the sensor head 48 is a control unit having a gas generator 56 and lateral control nozzles 58 arranged around an ignition stand-off tube 52 for a main shaped charge 54, with the tube 52 containing the formed charge 45 at its front end.

Additionally provided in the space 42 are an energy supply unit 62 and a fuze arrangement 64 having an electronic delay circuit for the time-delayed detonation of the main shaped charge 54. Here too to protect these units from corrosion, the interior space 42 is filled with a protective gas at a greater than atmospheric pressure.

The invention may be used with all projectiles having sensitive interior components, as well as, for example, tank munitions, mortar projectiles, grenade projectiles, rocket, mines, underwater bombs (depth charges), torpedoes and other similar charges filled with explosives.

FIG. 4 illustrates how the interior space of the carrier projectile 20 shown in FIG. 2 can be purged and flooded with protective gas.

Prior and during the introduction of the sub-ammunition units 24, which are stacked on top of one another on the base of the carrier projectile 39, into the carrier projectile 20, front portion 21 of the latter is connected to its base 39 by means of a bellows 66 having a connecting piece 68 which is disposed under the base 39. Connected to the connecting piece 68 is a vacuum connection 70, by way of which the air from the interior space of the carrier projectile 20 and from the space enclosed by the bellows 66 may be removed. In addition, the connecting piece 68 is provided with a gas connection 72, by way of which the protective gas may be supplied at a greater than atmospheric pressure to the previously described spaces. In this manner it is possible for the interior space of the carrier projectiles as well as individual projectiles to be purged and flooded, and also charged with greater than atmospheric pressure. Subsequent to completion of the assembly, the carrier projectile 20 is sealed—in a manner not shown in further detail - in the position shown in FIG. 2, opposite the carrier projectile base 39. Subsequent to the gas-filling process the assembly accessories (bellows 66 and connecting piece 68) are removed.

It will be understood that the above description of the present invention is susceptible to various modifications, changes and adaptations, and the same are intended to be comprehended within the meaning and range of equivalents of the appended claims.

What is claimed is:

1. In a projectile having an outer shell, an interior space defined by an interior surface of said outer shell containing at least one of corrosion sensitive disposable payloads and electronic components, the improvement wherein a protective gas for protecting said at least one of payloads and electronic components against corrosion fills the interior space at a greater than atmospheric pressure.

2. A projectile according to claim 1, wherein the protective gas is a noble gas.

3. A projectile according to claim 2, wherein the noble gas is one of argon and helium.

4. A projectile according to claim 1, wherein the protective gas is an inert gas.

5. A projectile according to claim 4, wherein the inert gas is nitrogen.

6. A projectile according to claim 1, wherein the protective gas is a reducing gas.

7. A projectile according to claim 6, wherein the reducing gas is a gas selected from the group of gases consisting of carbon monoxide, hydrogen, ammonia and methane gas.

8. A projectile according to claim 6, wherein the reducing gas is a mixture of gases selected from the group of gases consisting of carbon monoxide, hydrogen, ammonia and methane gas.

9. A projectile according to claim 1 wherein the protective gas has a pressure which is no greater than 30 bar.

10. A projectile according to claim 9, wherein the projectile is a carrier projectile, the interior space containing corrosion sensitive disposable payloads and corrosion sensitive electronic components.

11. A projective according to claim 10, wherein the projectile is a projectile having a caliber of 40 mm and the pressure of the protective gas is 15 bar.

12. A projectile according to claim 10, wherein the projectile has a caliber of 203 mm and the pressure of the protective gas is approximately 2 bar.

13. A projectile according to claim 9, wherein the projectile is a carrier projectile the interior space containing corrosion sensitive disposable payloads and corrosion sensitive electronic components, the interior space having a volume of 2.8 liters and containing the protective gas at a pressure of approximately 3 bar.

14. A process for protecting corrosion sensitive components in an interior space of a projectile, the projectile having an outer shell, and interior surface of the shell defining the interior space the process comprising the steps of: purging the interior space with a corrosion inhibiting protective gas; and leaving a quantity of the protective gas in the interior space.

15. A process as in claim 14, wherein said step of leaving a quantity of the protective gas includes charging the interior space with protective gas at a greater than atmospheric pressure.

16. A process according to claim 14, wherein the projectile is a carrier projectile, the interior space containing corrosion sensitive disposable payloads and corrosion sensitive electronic components, the protective gas protecting the payloads and electronic components from corrosion.

* * * * *